US010361492B1

(12) United States Patent
Yamashita

(10) Patent No.: US 10,361,492 B1
(45) Date of Patent: Jul. 23, 2019

(54) TERMINAL-EQUIPPED COVERED ELECTRIC WIRE AND WIRE HARNESS

(71) Applicants: AUTONETWORKS TECHNOLOGIES, LTD., Yokkaichi-shi, Mie (JP); SUMITOMO WIRING SYSTEMS, LTD., Yokkaichi-shi, Mie (JP); SUMITOMO ELECTRIC INDUSTRIES, LTD., Osaka-shi, Osaka (JP)

(72) Inventor: Takuya Yamashita, Yokkaichi (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 0 days.

(21) Appl. No.: 16/094,116

(22) PCT Filed: Apr. 11, 2017

(86) PCT No.: PCT/JP2017/014802

§ 371 (c)(1),
(2) Date: Oct. 16, 2018

(87) PCT Pub. No.: WO2017/183517

PCT Pub. Date: Oct. 26, 2017

(30) Foreign Application Priority Data

Apr. 22, 2016 (JP) ..... 2016-085960

(51) Int. Cl.
*H01R 4/18* (2006.01)
*H01B 7/00* (2006.01)
(Continued)

(52) U.S. Cl.
CPC ..... *H01R 4/185* (2013.01); *H01B 7/0045* (2013.01); *H01R 4/70* (2013.01); *H01R 13/533* (2013.01)

(58) Field of Classification Search
CPC ..... H01R 4/185
See application file for complete search history.

(56) References Cited

U.S. PATENT DOCUMENTS 6,514,064 B2 * 2/2003 Kondo ..... H01R 4/70 425/116
6,613,263 B2 * 9/2003 Kondo ..... H01R 4/70 264/263
(Continued)

FOREIGN PATENT DOCUMENTS

JP 2010-108829 A 5/2010
JP 2012-174447 A 9/2012
(Continued)

OTHER PUBLICATIONS

Jul. 4, 2017 International Search Report issued in International Patent Application No. PCT/JP2017/014802.

*Primary Examiner* — Ross N Gushi
(74) *Attorney, Agent, or Firm* — Oliff PLC

(57) ABSTRACT

A terminal-equipped covered electric wire and a wire harness in which an electrical connection portion where a terminal fitting and an electric wire conductor are electrically connected is covered with a resin cover portion. With the terminal-equipped covered electric wire and the wire harness, the terminal fitting is prevented from being damaged during insertion into a connector housing, and the resin cover portion has improved adhesiveness to the terminal fitting. Provided is a terminal-equipped covered electric wire in which a resin cover portion covering an electrical connection portion includes a first layer made of a thermoplastic elastomer having adhesiveness to the surface of a terminal
(Continued)

fitting, and a second layer made of a polyester resin. The adhesive strength between the thermoplastic elastomer and the polyester resin is 1.3 MPa or more. A wire harness including such a terminal-equipped covered electric wire is configured.

9 Claims, 2 Drawing Sheets

(51) Int. Cl.
*H01R 13/533* (2006.01)
*H01R 4/70* (2006.01)

(56) References Cited

U.S. PATENT DOCUMENTS 6,761,551 B2 * 7/2004 Kondo ..... B29C 45/14426 425/116
6,796,781 B2 * 9/2004 Kondo ..... B29C 45/14426 249/95
7,669,324 B2 * 3/2010 Daito ..... H01B 7/285 29/861
7,954,235 B2 * 6/2011 Martauz ..... H01R 4/184 174/84 C
8,360,803 B2 * 1/2013 Sakai ..... H01R 4/70 439/523
8,641,461 B2 * 2/2014 Mitose ..... H01R 4/185 439/587
8,723,040 B2 * 5/2014 Sakura ..... H01R 4/185 174/68.1
8,771,015 B2 * 7/2014 Inoue ..... H01R 4/70 439/604
8,951,063 B2 * 2/2015 Iio ..... H01R 13/5216 439/523
9,065,261 B2 * 6/2015 Kawamura ..... H01R 4/183
9,246,239 B2 * 1/2016 Inoue ..... H01R 4/62
9,287,655 B2 * 3/2016 Sato ..... H01R 4/70
9,293,838 B2 * 3/2016 Sakaguchi ..... H01R 4/62
9,368,929 B2 * 6/2016 Matsushita ..... H01R 11/12
9,397,437 B2 * 7/2016 Ohnuma ..... H01R 4/185
9,437,958 B2 * 9/2016 Naganishi ..... H01R 13/521
9,564,690 B2 * 2/2017 Kondo ..... H01R 4/70
9,640,879 B2 * 5/2017 Tanaka ..... H01R 4/185
9,647,352 B2 * 5/2017 Sato ..... H01R 4/70
9,647,382 B2 * 5/2017 Nabeta ..... H01R 4/185
9,663,863 B2 * 5/2017 Takata ..... C08L 23/26
9,667,011 B2 * 5/2017 Sato ..... H01R 4/70
9,673,586 B2 * 6/2017 Sato ..... H01R 4/70
9,721,700 B2 * 8/2017 Kuriyagawa ..... H01B 7/285
9,882,291 B2 * 1/2018 Shimizu ..... H01R 4/185
9,935,392 B2 * 4/2018 Ito ..... H01R 13/5216
2001/0003688 A1 * 6/2001 Kondo ..... B29C 45/14426 439/604
2002/0127915 A1 * 9/2002 Kondo ..... B29C 45/14426 439/606
2008/0185169 A1 * 8/2008 Daito ..... H01B 7/285 174/23 R
2008/0283268 A1 * 11/2008 Iwasaki ..... H01B 7/285 174/78
2011/0070781 A1 * 3/2011 Kitagawa ..... H01R 4/185 439/877
2012/0199391 A1 * 8/2012 Inoue ..... H01B 7/2806 174/72 A
2012/0325552 A1 * 12/2012 Sakura ..... H01R 4/185 174/74 R
2013/0052887 A1 * 2/2013 Inoue ..... H01R 4/70 439/877
2013/0072074 A1 * 3/2013 Inoue ..... H01R 4/70 439/886
2013/0098679 A1 * 4/2013 Takata ..... C08L 23/26 174/74 R
2013/0126235 A1 * 5/2013 Tanikawa ..... H01R 4/70 174/77 R
2013/0199842 A1 * 8/2013 Inoue ..... H01R 4/62 174/84 C
2013/0252459 A1 * 9/2013 Tanaka ..... H01R 4/185 439/523
2013/0303019 A1 * 11/2013 Ito ..... H01R 13/533 439/521
2013/0309903 A1 * 11/2013 Iio ..... H01R 13/5216 439/523
2013/0344752 A1 * 12/2013 Takayama ..... H01R 4/70 439/877
2015/0011116 A1 * 1/2015 Ohnuma ..... H01R 4/185 439/519
2015/0011117 A1 * 1/2015 Ohnuma ..... H01R 4/185 439/520
2015/0021090 A1 * 1/2015 Mano ..... H01R 4/185 174/72 A
2015/0091206 A1 * 4/2015 Sato ..... B29C 45/14065 264/229
2015/0111424 A1 4/2015 Sato et al.
2015/0132993 A1 * 5/2015 Osada ..... B29C 45/14639 439/606
2015/0140874 A1 * 5/2015 Sakaguchi ..... H01R 4/62 439/879
2015/0244133 A1 * 8/2015 Hanazaki ..... H01R 4/184 174/74 R
2015/0287496 A1 * 10/2015 Sato ..... H01R 4/62 174/74 R
2015/0368389 A1 * 12/2015 Tanaka ..... C09D 4/06 174/72 A
2016/0006233 A1 * 1/2016 Oshiumi ..... H01B 7/2806 174/76
2016/0134028 A1 * 5/2016 Kondo ..... H01R 4/70 439/877
2016/0156113 A1 * 6/2016 Tanaka ..... H01R 4/185 439/604

FOREIGN PATENT DOCUMENTS

JP 2013-214476 A 10/2013
JP 2014-13657 A 1/2014
JP 2016-047601 A 4/2016

* cited by examiner

TERMINAL-EQUIPPED COVERED ELECTRIC WIRE AND WIRE HARNESS

TECHNICAL FIELD

The present disclosure relates to a terminal-equipped covered electric wire and a wire harness, and more specifically relates to a terminal-equipped covered electric wire in which a resin cover portion for preventing corrosion is provided on an electrical connection portion where an electric wire conductor and a terminal fitting are electrically connected, and a wire harness using the terminal-equipped covered electric wire.

BACKGROUND ART

A terminal fitting is connected to an electric wire conductor at an end of a covered electric wire to be arranged in a vehicle such as an automobile. In an electrical connection portion where the electric wire conductor of the covered electric wire and the terminal fitting are electrically connected, there is a need to prevent corrosion. In particular, when different types of metal materials are in contact with each other in the electrical connection portion, there is a possibility that dissimilar metal corrosion will occur. In some cases, aluminum or an aluminum alloy is used as a material of the electric wire conductor of the electric wire to be used in a vehicle in order to reduce the weight of the vehicle. On the other hand, copper or a copper alloy is often used as a material of the terminal fittings. In addition, the surface of the terminal fittings is often plated with tin or the like. In this case, dissimilar metal corrosion is likely to become an issue in the electrical connection portion where an aluminum-based metal is in contact with a copper-based metal or a tin plating layer. Therefore, corrosion in the electrical connection portion needs to be reliably prevented.

The electrical connection portion may be covered with an adhesive resin in order to prevent corrosion in the electrical connection portion. For example, Patent Document 1 discloses that a resin cover portion is formed so as to cover the entire circumference of a crimped portion where an aluminum electric wire and a connection terminal made of a copper-based material are crimped together. The resin cover portion includes a polyamide resin as a main component, and is specified to have predetermined physical properties.

CITATION LIST

Patent Document

Patent Document 1: JP 2012-174447A

SUMMARY

Technical Problem

As described above, in Patent Document 1, the resin cover portion for covering the electrical connection portion where the terminal fitting and the electric wire conductor are electrically connected is made of a polyamide resin. However, a polyamide resin has a low elastic modulus and is prone to deformation, and therefore, when the terminal fitting that has been provided with the resin cover portion to prevent corrosion is inserted into a connector housing, the resin cover portion may be caught on the wall surface of the connector housing, and is thus likely to be damaged. When the resin cover portion is damaged, corrosion factors such as water may infiltrate through the damaged part and cause corrosion.

Therefore, it is conceivable that a resin cover portion is made of a resin material having an elastic modulus higher than that of a polyamide resin, and damage is thus prevented during insertion into the connector housing. However, if a resin material for the resin cover portion is selected based on the magnitude of the elastic modulus, the resin material will not necessarily exhibit high adhesiveness to the surface of the terminal fitting. When a resin material for the resin cover portion has insufficient adhesiveness to the surface of the terminal fitting, the resin cover portion fails to come into close contact with the terminal fitting, and thus corrosion factors such as water may infiltrate through the interface between the resin cover portion and the terminal fitting and cause corrosion in the electrical connection portion covered with the resin cover portion.

The problem to be solved by aspects of certain preferred embodiments is to provide a terminal-equipped covered electric wire and a wire harness in which an electrical connection portion where a terminal fitting and an electric wire conductor are electrically connected is covered with a resin cover portion. With the terminal-equipped covered electric wire and the wire harness, the terminal fitting is prevented from being damaged during insertion into a connector housing, and the resin cover portion has improved adhesiveness to the terminal fitting.

Solution to Problem

In order to solve the foregoing problems, a terminal-equipped covered electric wire according to a preferred embodiment is a terminal-equipped covered electric wire including: a terminal fitting; and a covered electric wire obtained by covering an outer circumference of an electric wire conductor with an insulator, the terminal fitting and the electric wire conductor being electrically connected in an electrical connection portion, wherein a resin cover portion that covers an end of the insulator and the electrical connection portion is provided, the resin cover portion includes a first layer made of a thermoplastic elastomer having adhesiveness to the surface of the terminal fitting, and a second layer made of a polyester resin, the first layer is arranged at at least a part of a portion of the resin cover portion covering the terminal fitting and is in contact with the surface of the terminal fitting, and the second layer is arranged to be in contact with the surface of the first layer and the surface of the insulator, and an adhesive strength between the thermoplastic elastomer and the polyester resin is 1.3 MPa or more.

Here, it is preferable that the polyester resin is polybutylene terephthalate resin. It is preferable that the thermoplastic elastomer is a polyester elastomer. It is preferable that the thermoplastic elastomer includes a hard segment and a soft segment, and the soft segment includes polar functional groups.

It is preferable that the adhesive strength of the thermoplastic elastomer to the surface of the terminal fitting is 1.0 MPa or more. It is preferable that the adhesive strength of the polyester resin to the insulator is 1.0 MPa or more. It is preferable that the polyester resin has an elastic modulus of 30 MPa or more.

It is preferable that the first layer is arranged at a partial region of the resin cover portion, and the second layer covers the entire surface of the first layer.

A wire harness according to a preferred embodiment includes the terminal-equipped covered electric wire as described above.

Advantageous Effects

In the above-mentioned terminal-equipped covered electric wire according to a preferred embodiment, the first layer made of a thermoplastic elastomer that exhibits adhesiveness to the surface of the terminal fitting is formed at a portion of the resin cover portion that covers the terminal fitting, and is in contact with the surface of the terminal fitting. The first layer comes into close contact with the surface of the terminal fitting, thus making it possible to prevent corrosion factors such as water from infiltrating the electrical connection portion covered with the resin cover portion from the terminal fitting side and causing corrosion.

The resin cover portion includes the second layer made of a polyester resin having a high elastic modulus. Therefore, when the terminal fitting is inserted into the connector housing, the resin cover portion is less likely to be caught thereon and damaged. A polyester resin exhibits high adhesiveness to the insulator of the covered electric wire as well as the thermoplastic elastomer in the first layer, thus making it possible to prevent corrosion factors from infiltrating through the interface between the second layer and the first layer or the interface between the second layer and the insulator, and causing corrosion.

In particular, when the adhesive strength between the thermoplastic elastomer and the polyester resin is set to 1.3 MPa or more, such high adhesive strength makes it possible to stably prevent corrosion factors from infiltrating through the interface between the first layer and the second layer in the resin cover portion, and high anticorrosiveness can be thus obtained.

When the polyester resin is polybutylene terephthalate resin, the second layer has a high elastic modulus, thus making it easier to avoid the damage caused during insertion into the connector housing. In addition, the second layer exhibits favorable adhesiveness to both the thermoplastic elastomer constituting the first layer and the insulator of the covered electric wire made of polyvinyl chloride or the like, thus making it easier to ensure high anticorrosiveness.

When the thermoplastic elastomer is a polyester elastomer, the polyester elastomer exhibits high adhesiveness to the surface of the terminal fitting as well as the polyester resin constituting the second layer.

When the thermoplastic elastomer includes the hard segment and the soft segment, and the soft segment includes polar functional groups, the first layer made of the thermoplastic elastomer exhibits high adhesiveness to the surface of the terminal fitting due to the interaction between the polar functional groups and the metal surface. As a result, high anticorrosiveness can be imparted to the resin cover portion.

When the adhesive strength of the thermoplastic elastomer to the surface of the terminal fitting is 1.0 MPa or more, such high adhesive strength makes it possible to stably prevent corrosion factors from infiltrating through the interface between the terminal fitting and the resin cover portion, and high anticorrosiveness can be thus obtained.

When the adhesive strength of the polyester resin to the insulator is 1.0 MPa or more, such high adhesive strength makes it possible to stably prevent corrosion factors from infiltrating through the interface between the insulator and the resin cover portion, and high anticorrosiveness can be thus obtained.

When the polyester resin has an elastic modulus of 30 MPa or more, such a high elastic modulus makes it easier to avoid a case where the polyester resin is damaged, for example, due to the terminal fitting being caught on the connector housing during insertion of the terminal fitting into the connector housing, and the anticorrosiveness of the resin cover portion is thus reduced.

When the first layer is arranged on a partial region of the resin cover portion, and the entire surface of the first layer is covered with the second layer, the first layer with a small area makes it possible to effectively prevent corrosion factors from infiltrating the region covered with the resin cover portion from the terminal fitting side. The entire surface of the first layer made of the thermoplastic elastomer is covered with the second layer made of the polyester resin, thus making it possible to prevent the first layer from being damaged during insertion of the terminal fitting into the connector housing.

The above-mentioned wire harness according to a preferred embodiment includes the terminal-equipped covered electric wire as mentioned above, thus making it possible to avoid a case where the resin cover portion of the terminal-equipped covered electric wire is damaged during insertion into the connector housing, and to obtain high anticorrosiveness due to the high adhesiveness of the resin cover portion to the terminal fitting.

DESCRIPTION OF EMBODIMENTS

Hereinafter, embodiments will be described in detail with reference to the drawings.

Terminal-Equipped Covered Electric Wire

Overall Configuration

Figure 1:
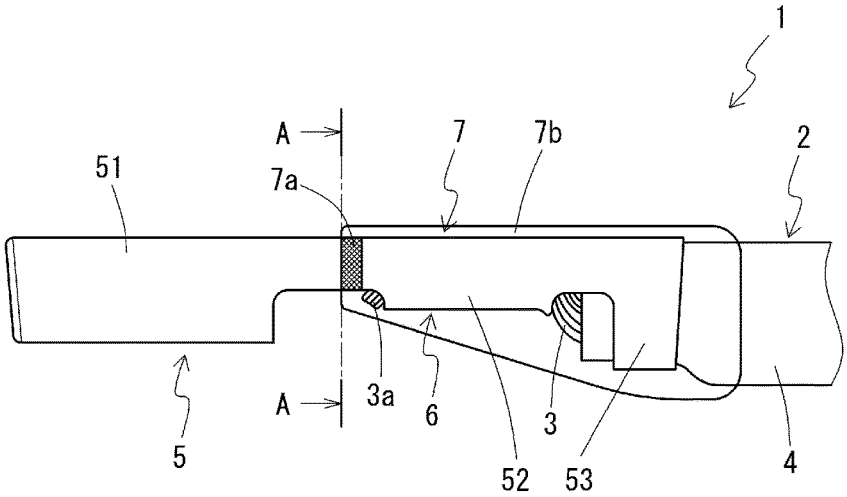
FIG. 1 is a see-through side view of a terminal-equipped covered electric wire according to an embodiment.
Figure 2:
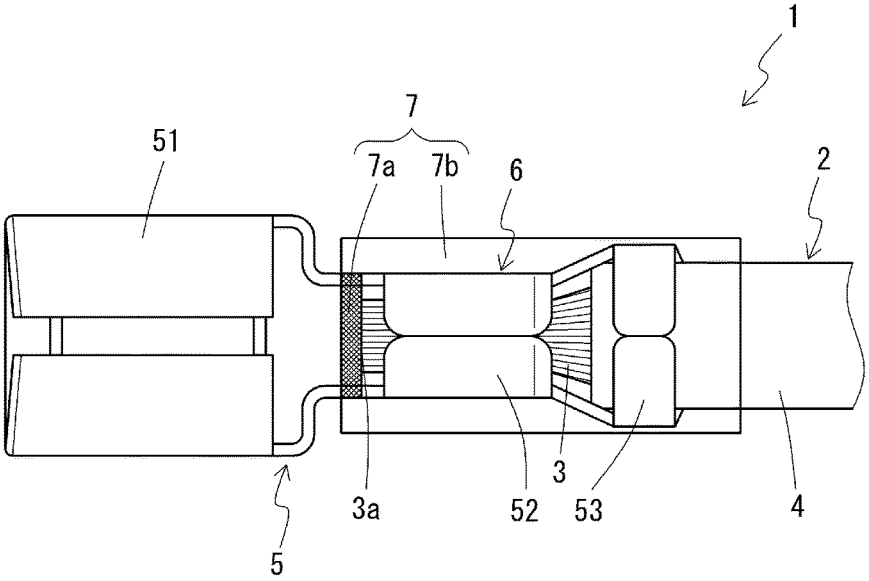
FIG. 2 is a see-through bottom view of the terminal-equipped covered electric wire.

As shown in FIGS. 1 and 2, a terminal-equipped covered electric wire 1 has a configuration in which an electric wire conductor 3 of a covered electric wire 2 in which the electric wire conductor 3 is covered with an insulator 4 is electrically connected to a terminal fitting 5 at an electrical connection portion 6.

The terminal fitting 5 includes a connection portion 51. The terminal fitting 5 further includes an electric wire fixation portion that is formed to extend from the end of the connection portion 51 and includes a wire barrel 52 and an insulation barrel 53. The connection portion 51 is configured as a fitting connection portion of a female fitting terminal, and is formed in a box shape into which a male connection terminal (not shown) can be fitted.

In the electrical connection portion 6, the insulator 4 at the end of the covered electric wire 2 is stripped, and the electric wire conductor 3 is thus exposed. This exposed electric wire conductor 3 is crimped to one side (lower side in FIG. 1) of the terminal fitting 5, and the covered electric wire 2 and the terminal fitting 5 are thus connected to each other. The wire barrel 52 of the terminal fitting 5 is crimped onto the electric wire conductor 3 of the covered electric wire 2, and the electric wire conductor 3 and the terminal fitting 5 are thus electrically connected to each other. The insulation barrel 53 of the terminal fitting 5 is crimped onto the insulator 4 of the covered electric wire 2.

Figure 3:
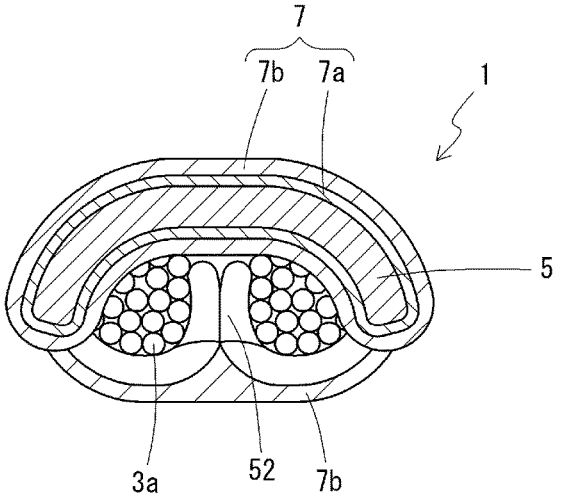
FIG. 3 is a cross-sectional view taken along line A-A in FIG. 1. It should be noted that the structure of a portion located on the rear side with respect to a wire barrel is omitted.

In the terminal-equipped covered electric wire 1, a resin cover portion 7 made of a resin material is formed to cover a portion including the electrical connection portion 6. Specifically, the resin cover portion 7 covers the following portions. That is, as shown in FIGS. 1 and 2, the resin cover portion 7 extends over a region between a position on the leading end side (connection portion 51 side) with respect to an end 3*a* of the electric wire conductor 3 and a position on the base end side (covered electric wire 2 side) with respect to an end of the insulation barrel 53 in the longitudinal direction of the terminal-equipped covered electric wire 1, and covers the entire connection portion 6 and a partial region of the insulator 4 at the end of the covered electric wire 2. As shown in FIGS. 1 to 3, the resin cover portion 7 covers the entire circumferences of the terminal fitting 5, the electrical connection portion 6, and the covered electric wire 2 in the circumferential direction of the terminal-equipped covered electric wire 1. The portion where the end of the covered electric wire 2 is stripped and the electric wire conductor 3 is exposed is also completely covered with the resin cover portion 7, and is not exposed to the outside. The resin cover portion 7 includes a first layer 7*a* and a second layer 7*b* that are made of different materials, and the materials and the arrangement thereof will be described later in detail.

In general, the portion of the terminal fitting 5 including the electrical connection portion 6 is inserted into a hollow connector housing (not shown) made of a resin material such as polybutylene terephthalate (PBT), and the terminal-equipped covered electric wire 1 is thus used as a connector.

Hereinafter, the specific configurations of the covered electric wire 2, the terminal fitting 5, and the resin cover portion 7, which are included in the terminal-equipped covered electric wire 1, will be described.

Covered Electric Wire

The electric wire conductor 3 of the covered electric wire 2 is constituted by a stranded wire obtained by twisting a plurality of strands together. In this case, the stranded wire may be constituted by a single metal strand or two or more metal strands. Apart from a metal strand, the stranded wire may include a strand or strands made of an organic fiber, or the like. The stranded wire may include a reinforcement wire (tension member) or the like for reinforcing the covered electric wire 2.

Examples of the material of the metal strand constituting the above-mentioned electric wire conductor 3 include copper, a copper alloy, aluminum, and an aluminum alloy, or a material obtained by applying various types of plating to these materials. Moreover, examples of the material of the metal strand serving as the reinforcement wire include a copper alloy, titanium, tungsten, and stainless steel. Furthermore, one example of the organic fiber serving as the reinforcement wire is Kevlar.

Examples of the material of the insulator 4 include rubber, polyolefin, a halogen-based polymer such as PVC, and a thermoplastic elastomer. These materials may be used alone or in combination of two or more. Various additives may be added to the material of the insulator 4 as appropriate. Examples of the additive include a flame retardant, a filler, and a coloring agent.

Terminal Fitting

Examples of the material of the terminal fitting 5 (material of a base material) include various copper alloys and copper in addition to brass, which is commonly used. A portion (e.g., a contact point) of the surface of the terminal fitting 5 or the entire surface of the terminal fitting 5 may be plated with various types of metal, such as tin, nickel, gold or alloys thereof.

As described above, the electric wire conductor 3 and the terminal fitting 5 may be made of any metal material. However, when dissimilar metals are in contact with each other in the electrical connection portion 6 as in the case where the terminal fitting 5 is made of a common terminal material obtained by plating a base material made of copper or a copper alloy with tin and the electric wire conductor 3 includes strands made of aluminum or an aluminum alloy, corrosion is particularly likely to occur in the electrical connection portion 6 as a result of coming into contact with corrosion factors such as moisture. However, covering the electrical connection portion 6 with the resin cover portion 7 as described below makes it possible to suppress such dissimilar metal corrosion.

Resin Cover Portion

As described above, the resin cover portion 7 covers the electrical connection portion 6 where the terminal fitting 5 and the electrical wire conductor 3 are electrically connected, and thus prevents water and the like from infiltrating the electrical connection portion 6 from the outside. As a result, the resin cover portion 7 acts to prevent corrosion of the electrical connection portion 6 caused by corrosion factors such as water. As mentioned above, the resin cover portion 7 includes the first layer 7*a* and the second layer 7*b*, which are made of different materials. The configuration of the resin cover portion 7 will be described with reference to FIGS. 1 to 3.

The first layer 7*a* extends from the leading end (edge on the connection portion 51 side) of the resin cover portion 7 in the longitudinal direction and occupies a portion of the resin cover portion 7. The first layer 7*a* is in direct contact with the surface of the terminal fitting 5. As shown in FIG. 3, the metal material is curved in a reversed U-shape in a portion between the wire barrel 52 and the connection portion 51 in the terminal fitting 5, and the first layer 7*a* covers the entire circumference of this portion.

The second layer 7*b* is formed over the entire region of the resin cover portion 7, including the portion covering the surface of the first layer 7*a*, in the longitudinal direction and the circumferential direction. The second layer 7*b* is in contact with the surface of the first layer 7*a* in the region in which the first layer 7*a* is formed. On the other hand, the second layer 7*b* covers the surfaces of the terminal fitting 5, the electric wire conductor 3, and the insulator 4 in the regions in which the first layer 7*a* is not formed. In particular, the second layer 7*b* is in direct contact with the insulator 4 on the surface of the insulator 4.

The first layer 7*a* is made of a thermoplastic elastomer (TPE) having adhesiveness to the surface of the terminal fitting 5. On the other hand, the second layer 7*b* is made of a polyester resin. The adhesive strength between the thermoplastic elastomer constituting the first layer 7*a* and the polyester resin constituting the second layer 7*b* is 1.3 MPa or more. The adhesive strength can be measured as tensile shear adhesive strength by performing a shear adhesive test in conformity with JIS K6850 (the same applies to the adhesive strengths between the materials hereinafter).

As mentioned above, the first layer 7*a* that comes into contact with the surface of the terminal fitting 5 is made of a thermoplastic elastomer. In general, a thermoplastic elastomer includes a hard segment and a soft segment, and exhibits high adhesiveness to a metal surface such as a tinned surface constituting the surface of the terminal fitting 5, due to an effect of the presence of the soft segment.

There is no particular limitation on the type of thermoplastic elastomer constituting the first layer 7*a*, but favorable examples thereof include a polyester elastomer in which the hard segment includes polyester units, a polyamide elastomer in which the hard segment includes polyamide units, and a polyurethane elastomer in which the hard segment includes polyurethane units. The thermoplastic elastomer may contain various additives.

It is particularly preferable to use the polyester elastomer of the above-mentioned elastomers as the thermoplastic elastomer. The polyester elastomer exhibits high adhesiveness to the surface of the terminal fitting 5 made of a tinned copper alloy or the like, and also exhibits high adhesiveness to the second layer 7*b* made of a polyester resin, which is a polymer of the same type, due to the hard segment including polyester units.

It is preferable that the side chains in the soft segment included in the thermoplastic elastomer include polar functional groups. Examples of the polar functional groups include a hydroxyl group, an amide group, an amino group, and a carboxyl group. The soft segment can interact with the metal surface via the polar functional groups due to the presence of the polar functional groups, thus making it possible to improve the adhesiveness of the first layer 7*a* to the surface of the terminal fitting 5. In particular, when the side chains of the soft segment include hydroxyl groups, hydrogen bonds are formed with hydroxyl groups present on the metal surface derived from absorbed water or the like, and high interfacial adhesive strength is thus obtained.

The adhesive strength of the thermoplastic elastomer to the surface of the terminal fitting 5 made of a tinned copper alloy or the like is higher than at least that of the polyester resin constituting the second layer 7*b*, and is preferably 1.0 MPa or more, and more preferably 1.1 MPa or more. Furthermore, as mentioned above, the thermoplastic elastomer has an adhesive strength of 1.3 MPa or more to the polyester resin constituting the second layer 7*b*. The adhesive strengths of the thermoplastic elastomer with respect to the surface of the terminal fitting 5 and the polyester resin can be adjusted by adjusting the types of the hard segment and the soft segment constituting the thermoplastic elastomer, the presence or absence of the polar functional groups, the type of the polar functional groups, the ratio of the hard segment and the soft segment, the degree of polymerization, additional components, and the like.

As mentioned above, the second layer 7*b*, which is in contact with the first layer 7*a* and the surface of the insulator 4 of the covered electric wire 2, is made of a polyester resin. The polyester resin includes only polyester units, and does not include a soft segment unlike the above-mentioned thermoplastic elastomer.

The polyester resin does not exhibit high adhesiveness to the metal surface, but exhibits high adhesiveness to the resin material such as PVC constituting the insulator 4 of the covered electric wire 2. In addition, the polyester resin has a high elastic modulus.

There is no particular limitation on the polyester resin constituting the second layer 7*b*, but specific examples thereof include polybutylene terephthalate (PBT) and polyethylene terephthalate (PET). It is particularly preferable to use PBT of these polyester resins for the reasons that PBT exhibits high adhesiveness to the insulator 4 of the covered electric wire 2, and PBT has a high elastic modulus, for example. The polyester resin may contain various additives.

The adhesive strength of the polyester resin to the surface of the insulator 4 of the covered electric wire 2, which is made of PVC or the like, is preferably 1.0 MPa or more and more preferably 2.0 MPa or more. It is preferable that the elastic modulus of the polyester resin is higher than at least that of the thermoplastic elastomer constituting the first layer 7*a*. The elastic modulus (tensile elastic modulus) of the polyester resin is preferably 30 MPa or more and more preferably 40 MPa or more. The tensile elastic modulus can be evaluated in conformity with JIS K 7161. The adhesive strengths of the polyester resin to the surface of the insulator 4 and the thermoplastic elastomer constituting the first layer 7*a*, and the elastic modulus thereof can be adjusted by adjusting the specific type of polyester resin, the degree of polymerization, additional components, and the like.

As described above, in the resin cover portion 7 of the terminal-equipped covered electric wire 1 according to this embodiment, the first layer 7*a* made of a thermoplastic elastomer is formed at at least a part of the portion covering the terminal fitting 5, and is in contact with the surface of the terminal fitting 5. The second layer 7*b* made of a polyester resin is in contact with both the the surface of the first layer 7*a* and the surface of the insulator 4 of the covered electric wire 2.

A polyester resin such as PBT constituting the second layer 7*b* exhibits substantially no adhesiveness to the surface of the terminal fitting 5 made of metal such as a tinned copper alloy. Therefore, if the resin cover portion 7 is constituted by only the polyester resin, corrosion factors such as water will be allowed to infiltrate the electrical connection portion 6 covered with the resin cover portion 7 from the end on the terminal fitting 5 side of the resin cover portion 7, and sufficient anticorrosiveness of the resin cover portion 7 is not obtained. However, in the terminal-equipped covered electric wire 1 according to this embodiment, the first layer 7*a* made of a thermoplastic elastomer that exhibits high adhesiveness to the surface of the metal constituting the terminal fitting 5 is provided and is in contact with the surface of the terminal fitting 5, thus making it possible to prevent corrosion factors such as water from infiltrating from the end on the terminal fitting 5 side of the resin cover portion 7 due to the adhesive effect of the first layer 7*a*. The first layer 7*a* exhibits high adhesiveness to both the terminal fitting 5 and the polyester resin constituting the second layer 7*b*, and thus functions as one type of bonding layer for bonding the second layer 7*b* to the surface of the terminal fitting 5.

Here, the adhesive strength between the thermoplastic elastomer constituting the first layer 7*a* and the polyester resin constituting the second layer 7*b* is 1.3 MPa or more, thus making it possible to sufficiently block the infiltration of corrosion factors through the interface between the first layer 7*a* and the second layer 7*b* and achieve high anticorrosiveness of the resin cover portion 7. If the adhesive strength between the thermoplastic elastomer constituting the first layer 7*a* and the polyester resin constituting the second layer 7*b* is less than 1.3 MPa, corrosion factors will be allowed to infiltrate through the interface between the first layer 7*a* and the second layer 7*b* due to insufficient adhesiveness between the first layer 7*a* and the second layer 7*b*, thus making it difficult to obtain sufficient anticorrosiveness required for a terminal-equipped covered electric wire to be used in an automobile.

The polyester resin constituting the second layer 7*b* exhibits high adhesiveness to the insulator 4 of the covered electric wire 2 that is made of a resin material such as PVC. Therefore, providing the second layer 7*b* in the resin cover portion 7 so that it comes into contact with the insulator 4 makes it possible to suppress the infiltration of corrosion factors such as water from the end on the covered electric wire 2 side of the resin cover portion 7. The second layer 7*b* is provided to be in contact with the surface of the first layer 7*a*, and both the layers 7*a* and 7*b* exhibit high adhesiveness to each other, thus making it possible to suppress the infiltration of corrosion factors such as water from all of the end on the terminal fitting 5 side, the end on the covered electric wire 2 side, and a joint portion where the first layer 7*a* and the second layer 7*b* are joined to each other in the resin cover portion 7. As a result, dissimilar metal corrosion can be prevented in the electrical connection portion 6 covered with the resin cover portion 7. Even though a portion of the second layer 7*b* covering the terminal fitting 5 other than the portion provided with the first layer 7*a* is not in close contact with the surface of the terminal fitting 5, the end on the terminal fitting 5 side of the resin cover portion 7 is sealed with the first layer 7*a*, which is in close contact with the surface of the terminal fitting 5, and the end on the covered electric wire 2 side of the resin cover portion 7 is sealed with the second layer 7*b*, which is in close contact with the insulator 4, thus making it possible to suppress the infiltration of corrosion factors from both ends in the longitudinal direction in the resin cover portion 7 as a whole.

Furthermore, the polyester resin constituting the second layer 7*b* has a high elastic modulus unlike the polyamide resin disclosed in Patent Document 1 and the like. Therefore, even if the resin cover portion 7 comes into contact with the inner wall surface of the connector housing or the like while the terminal fitting 5 is inserted into the connector housing, the resin cover portion 7 is less likely to be caught on the connector housing. As a result, the resin cover portion 7 is less likely to be damaged during insertion into the connector housing. If the resin cover portion 7 is damaged, corrosion factors such as water may infiltrate through the damaged part and cause dissimilar metal corrosion in the electrical connection portion 6.

The first layer 7*a* may occupy any region in the resin covering portion 7 in the longitudinal direction and the circumferential direction of the terminal-equipped covered electric wire 1 as long as the first layer 7*a* is provided so as to be in contact with the surface of the terminal fitting 5. The first layer 7*a* may be provided to reach the surface of the portion between the wire barrel 52 and the connection portion 51 in the terminal fitting 5, the end 3*a* of the electric wire conductor 3, the wire barrel 52, the insulation barrel 53, or the surface of the covered electric wire 2. However, when the first layer 7*a* is formed to occupy the region including the portion on the leading end side (connection portion 51 side) with respect to the end 3*a* of the electric wire conductor 3, specifically, a part of the region extending from the end on the terminal fitting 5 side of the resin cover portion 7, in the longitudinal direction as in the above-described form, even a first layer 7*a* with a small area makes it possible to effectively prevent corrosion factors from infiltrating the electrical connection portion 6 from the terminal fitting side. There is also no limitation on the arrangement of the first layer 7*a* in the circumferential direction as long as a route by which corrosion factors infiltrate from the end on the terminal fitting 5 side of the resin cover portion 7 can be sealed. However, it is preferable that the first layer 7*a* is formed over the entire region in which the resin cover portion 7 extends along the circumference of the terminal fitting 5 as in the above-described form where the first layer 7*a* covers the entire circumference of the terminal fitting 5. For example, an exemplary form can be shown in which the first layer 7*a* is formed to cover the entire circumference of a portion of the terminal fitting 5 between the position of the end 3*a* of the electric wire conductor 3 and a position that is 1.0 mm or more apart therefrom toward the leading end of the terminal fitting 5.

The second layer 7*b* may also occupy any region of the resin cover portion 7 as long as the second layer 7*b* is provided so as to be in contact with both the surface of the first layer 7*a* and the surface of the insulator 4 of the covered electric wire 2. However, when the second layer 7*b* is formed to cover the entire surface of the first layer 7*a* as in the above-described form, a second layer 7*b* made of the polyester resin is formed on the entire surface of the resin cover portion 7, thus making it possible to protect the entire resin cover portion 7 including the first layer 7*a* from being damaged during insertion into the connector housing.

In a method for manufacturing the terminal-equipped covered electric wire 1, first, the terminal fitting 5 need only be crimped and fixed to the end of the covered electric wire 2 at which the insulator 4 has been stripped. Then, a layer of a thermoplastic elastomer is arranged at a predetermined position in the electrical connection portion 6, which is a crimped portion where the electric wire conductor 3 and the terminal fitting 5 are crimped to each other, through application, injection molding, or the like, to form the first layer 7*a*. Thereafter, a layer of the polyester resin is arranged at a predetermined position through application, injection molding, or the like in the same manner to form the second layer 7*b*. It should be noted that, when the first layer 7*a* is formed only on the surface of the terminal fitting 5 as in the above-described form, the first layer 7*a* may be formed at a predetermined position on the surface of the terminal fitting 5 before the covered electric wire 2 is connected to the terminal fitting 5.

Wire Harness

A wire harness according to an embodiment includes a plurality of covered electric wires including the above-described terminal-equipped covered electric wire 1 according to the embodiment. All of the covered electric wires included in the wire harness may be the terminal-equipped covered electric wire 1 according to the embodiment, or only a portion thereof may be the terminal-equipped covered electric wire 1 according to the embodiment of the present invention.

EXAMPLES

Hereinafter, examples and comparative examples will be described. It should be noted that the present invention is not limited to these examples.

Relationship of Adhesiveness Between Materials to Anti-corrosiveness

Used Materials

The following polymer materials were used as a material of the resin cover portion in order to evaluate the relationship of the adhesiveness between the materials to the anti-corrosiveness of the resin cover portion.

- PBT resin A: "NOVADURAN 5010R5" manufactured by Mitsubishi Engineering-Plastics Corporation
- PBT resin B: "DURANEX 2002" manufactured by Polyplastics Co., Ltd.
- Thermoplastic elastomer A: Polyester elastomer "Hytrel HTD-741H" (polar functional group: hydroxyl group) manufactured by Du Pont-Toray Co., Ltd.

Thermoplastic elastomer B: Polyester elastomer "PRIMALLOY GK320" (polar functional group: carboxyl group) manufactured by Mitsubishi Chemical Corporation Thermoplastic elastomer C: Polyester elastomer "PELPRENE EN type" (polar functional group: none) manufactured by TOYOBO Co., Ltd.

Adhesiveness Test

The above-mentioned polymer materials were injection-molded on the surfaces of tinned copper alloy plates used as a model of a material of the terminal fitting in order to evaluate the adhesive strength of the polymer materials to the surface of the terminal fitting. Moreover, the PBT resins were injection-molded on the surfaces of PVC sheets used as a model of the insulator of the covered electric wire in order to evaluate the adhesive strength to the insulator of the covered electric wire. Furthermore, the thermoplastic elastomers were injection-molded on the surfaces of the tinned copper alloy plates, and then the PBT resins were injection-molded on the surfaces of the thermoplastic elastomers in order to evaluate the adhesiveness between the PBT resin and the thermoplastic elastomer.

The adhesive strengths of the test pieces produced as described above were evaluated. The adhesive strengths were measured as tensile shear adhesive strengths by performing a shear adhesive test in conformity with JIS K6850.

Evaluation of Anticorrosiveness

First, a covered electric wire was produced in order to evaluate the anticorrosiveness of the terminal-equipped covered electric wire. Specifically, 40 parts by mass of diisononyl phthalate acting as a plasticizer, 20 parts by mass of calcium bicarbonate acting as a filler, and 5 parts by mass of a calcium-zinc based stabilizer acting as a stabilizer were mixed to 100 parts by mass of polyvinyl chloride (degree of polymerization: 1300) at 180° C. using an open roll, and then the mixture was molded into a pellet using a pelletizer. A polyvinyl chloride composition was thus prepared. Next, the circumference of a conductor (with a cross-sectional area of 0.75 $mm^2$) constituted by an aluminum alloy stranded wire obtained by twisting seven aluminum alloy strands together was extrusion-covered with the thus obtained polyvinyl chloride composition using a 50-mm extruder. A covered electric wire (PVC electric wire) was thus produced.

After an end of the thus produced covered electric wire was stripped and the electric wire conductor was exposed, a male crimp terminal fitting (including a wire barrel and an insulation barrel) made of brass, which is used for various purposes in an automobile, was crimped to the end of the covered electric wire.

Next, in Example 1 and Comparative Examples 1 to 5, a thermoplastic elastomer was applied with a thickness of 0.1 mm to cover the entire circumference of a region of the crimped terminal between the end of the electric wire and a position that was 1 mm away therefrom toward the leading end. After the thermoplastic elastomer had solidified, a PBT resin was applied with a thickness of 0.2 mm to cover the entire circumference of the crimped portion (electrical connection portion) where the covered electric wire and the terminal fitting were crimped to each other including the region to which the thermoplastic elastomer was applied. Here, the thermoplastic elastomer and the PBT resin were applied after the polymer materials were heated to 230° C. and liquefied, and then solidified. In Comparative Examples 6 and 7, the thermoplastic elastomer was not applied, and the PBT resin was directly applied to the electrical connection portion. Terminal-equipped covered electric wires of the example and comparative examples were thus produced.

The produced terminal-equipped covered electric wires were evaluated for their anticorrosiveness. Specifically, the produced terminal-equipped covered electric wires were left to stand in an incubator at 120° C. for 120 hours. Next, a neutral salt water spray test (using a salt solution with a concentration of 50 g/L) was performed at 35° C. in conformity with JIS C00024, and then the occurrence of rust was evaluated after 120 hours. When the occurrence of rust was not visually confirmed, the anticorrosiveness was evaluated to be sufficient ("Good"), and when the occurrence of rust was visually confirmed, the anticorrosiveness was evaluated to be insufficient ("Poor").

Test Results

Table 1 below shows the evaluation results of the adhesive strengths of the polymers with respect to the tinned copper alloy plate and PVC. Table 1 also shows the evaluation results of the adhesive strengths at the interfaces between the PBT resins and the thermoplastic elastomers.

TABLE 1

| Tensile adhesive strength [Mpa] | | Polymer material | | | | |
|---|---|---|---|---|---|---|
| | | PBT resin A | PBT resin B | Thermoplastic elastomer A | Thermoplastic elastomer B | Thermoplastic elastomer C |
| Adhesion target surface | Tinned copper alloy plate | 0.00 | 0.00 | 1.12 | 0.64 | 0.42 |
| | PVC | 2.15 | 0.95 | — | — | — |
| | PBT resin A | — | — | 1.32 | 0.32 | 0.85 |
| | PBT resin B | — | — | 1.19 | 0.47 | 0.99 |

As shown in Table 1, the PBT resins did not exhibit adhesiveness to the tinned copper alloy plate, whereas the thermoplastic elastomers exhibited adhesiveness. In particular, thermoplastic elastomer A including hydroxyl groups as the functional groups had a high adhesive strength of 1.0 MPa or more.

All the PBT resins exhibited adhesiveness to the PVC. In particular, PBT resin A exhibited a high adhesive strength of 1.0 MPa or more.

It was confirmed that any combination of the PBT resin and the thermoplastic elastomer had adhesiveness at the interface therebetween. In particular, thermoplastic elastomer A had a high adhesive strength of 1.3 MPa or more with respect to PBT resin A.

Table 2 below shows the evaluation results of the anticorrosiveness of Example 1 and Comparative Examples 1 to 5, which were different in the combination of the PBT resin and the thermoplastic elastomer constituting the resin cover portion, and Comparative Examples 6 and 7 in which the resin cover portion included only the PBT resin.

TABLE 2

| | Ex. | Comp. Ex. | | | | | | |
|---|---|---|---|---|---|---|---|---|
| | 1 | 1 | 2 | 3 | 4 | 5 | 6 | 7 |
| PBT Resin | A | A | A | B | B | B | A | B |
| Thermoplastic elastomer | A | B | C | A | B | C | — | — |
| Evaluation of anticorrosiveness | Good | Poor | Poor | Poor | Poor | Poor | Poor | Poor |

As shown in Table 2, Comparative Examples 6 and 7 in which the resin cover portion included only the PBT resin had insufficient anticorrosiveness. It is construed that the reason for this is that the PBT resin had substantially no adhesiveness to the tinned copper alloy plate constituting the terminal fitting.

In contrast, Example 1 in which the thermoplastic elastomer was used for the resin cover portion and the adhesive strength between the thermoplastic elastomer and the PBT resin was 1.3 MPa or more had sufficient anticorrosiveness. It is construed that the reason for this is that, even though the PBT resin did not have adhesiveness to the surface of the terminal fitting, the thermoplastic elastomer having adhesiveness to both the surface of the terminal fitting and the PBT resin served as a bonding layer, and salt water was thus prevented from infiltrating the region covered with the resin cover portion from the terminal fitting side. Since a high adhesive strength of 1.3 MPa or more was achieved at the interface between the PBT resin and the thermoplastic elastomer, salt water was significantly prevented from infiltrating through the interface therebetween. In addition, in Example 1, a high adhesive strength of 1.0 MPa or more was achieved at both the interface between the PBT resin and the PVC constituting the insulator of the covered electric wire, and the interface between the thermoplastic elastomer and the tinned copper alloy plate constituting the terminal fitting, which is also thought to contribute to high anticorrosiveness.

In Comparative Examples 1 to 5, adhesiveness was achieved at the interface between the PBT resin and the insulator of the covered electric wire, the interface between the thermoplastic elastomer and the terminal fitting, and the interface between the PBT resin and the thermoplastic elastomer, but the adhesive strength at the interface between the PBT resin and the thermoplastic elastomer was less than 1.3 MPa. It is construed that, as a result, salt water could not be sufficiently prevented from infiltrating through the interface between the PBT resin and the thermoplastic elastomer, thus lowering the anticorrosiveness.

Relationship Between Elastic Modulus of Resin Material and Damage

Used Materials

The following PBT resins and polyamide resins (PA resins) were used as a material of the resin cover portion in order to evaluate the relationship between the elastic modulus of the resin material and damage to the resin material during insertion into the connector housing. PBT resin A, PBT resin B, and thermoplastic elastomer A were the same as those used for the evaluation in "Relationship of adhesiveness between materials to anticorrosiveness" above. PA resin C was a PA resin of the same type as that used in Examples in Patent Document 1.

PBT resin A: "NOVADURAN 5010R5" manufactured by Mitsubishi Engineering-Plastics Corporation PBT resin B: "DURANEX 2002" manufactured by Polyplastics Co., Ltd.

PA resin A: "Alamin CM3511G3" manufactured by TORAY Industries Inc.

PA resin B: "Genestar N1002A" manufactured by KURARAY Co., Ltd.

PA resin C: "Macromelt 6801" manufactured by Henkel Japan Ltd.

Thermoplastic elastomer A: "Hytrel HTD-741H" manufactured by Du Pont-Toray Co., Ltd.

Evaluation of Elastic Modulus

The tensile elastic moduli of the above-mentioned PBT resins and polyamide resins were evaluated in conformity with JIS K 7161. JIS No. 1 dumbbell test pieces obtained by injection-molding the resin materials were used as test pieces.

Damage Test

Terminal-equipped covered electric wires similar to those used for the evaluation of the anticorrosiveness in "Relationship of adhesiveness between materials to anticorrosiveness" above were produced. At this time, thermoplastic elastomer A was applied with a thickness of 0.2 mm to cover the entire circumference of a region of the crimped terminal between the end of the electric wire and a position that was 1 mm away therefrom toward the leading end, and thereafter, each of the PBT resins and the PA resins was applied with a thickness of 0.2 mm to cover the entire circumference of the electrical connection portion where the covered electric wire and the terminal fitting were crimped to each other including the region to which the thermoplastic elastomer had been applied. The resin cover portion was thus produced.

Figure 4:
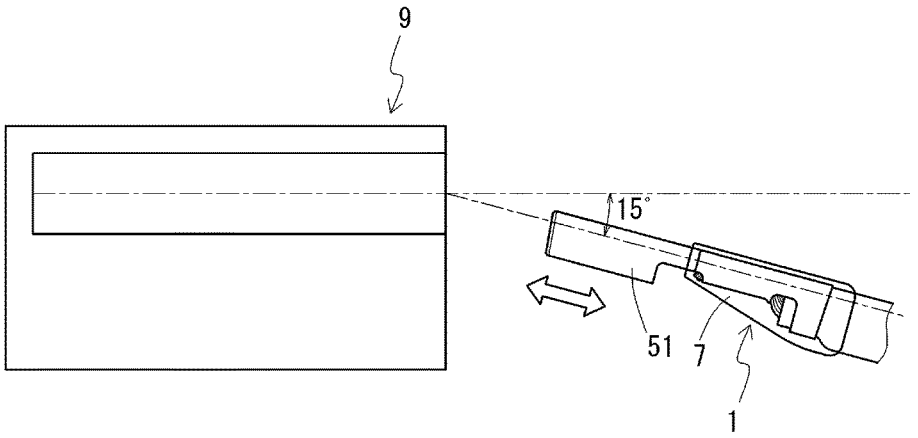
FIG. 4 is a side view illustrating a damage testing method.

Each of the obtained terminal-equipped covered electric wires was inserted into a connector housing (made of PBT) suitable for the terminal fitting. At this time, as shown in FIG. 4, the terminal-equipped covered electric wire 1 was inserted in a state in which the terminal-equipped covered electric wire 1 was inclined at 15° toward the connection portion 51 of the terminal fitting 5 with respect to the axis of a connector housing 9. Then, the terminal-equipped covered electric wire 1 was removed from the connector housing 9 at the same angle. After the terminal-equipped covered electric wire 1 was removed, the surface of the resin material of the resin cover portion 7 was visually observed. When a crack and peeling were not observed on the surface, the surface was determined to be not damaged ("Good"), and when at least one of a crack and peeling was observed on the surface, the surface was determined to be damaged ("Poor").

Evaluation of Anticorrosiveness

The anticorrosiveness of the terminal-equipped covered electric wires that were inserted into the connector housing and removed therefrom in the above-mentioned damage test was evaluated. Specifically, the terminal-equipped covered electric wires were left to stand in an incubator at 100° C. for 200 hours. Next, a neutral salt water spray test was performed using a salt solution with a concentration of 50 g/L at 35° C. in conformity with JIS C 0024. After 150 hours, whether or not rust occurred in the electrical connection portion was visually evaluated. When the occurrence of rust was not confirmed, the anticorrosiveness was evaluated to be sufficient ("Good"), and when the occurrence of rust was confirmed, the anticorrosiveness was evaluated to be insufficient ("Poor").

Test Results

Table 3 below shows the elastic moduli of the PBT resins and PA resins, and the results of the damage test and the evaluation of the anticorrosiveness that were performed on the terminal-equipped covered electric wires manufactured using those resins.

TABLE 3

| | Ex. | Comp. Ex. | | | |
|---|---|---|---|---|---|
| | 2 | 8 | 9 | 10 | 11 |
| Resin material | PBT resin A | PBT resin B | PA resin A | PA resin B | PA resin C |
| Tensile elastic modulus [MPa] | 40 | 31 | 29 | 20 | 15 |
| Damage test | Good | Good | Poor | Poor | Poor |
| Evaluation of anticorrosiveness | Good | Good | Poor | Poor | Poor |

As shown in Table 3, PBT resin A used in Example 2 had an elastic modulus of 30 MPa or more. Accordingly, the resin cover portion of Example 2 was not damaged in the damage test, and it was confirmed that the terminal-equipped covered electric wire of Example 2 had sufficient anticorrosiveness in the evaluation of the anticorrosiveness. It is construed that, since the PBT resin exposed on the surface of the resin cover portion had a high elastic modulus, the resin cover portion was not caught on the connector housing even when the resin cover portion came into contact with the connector housing while the terminal-equipped covered electric wire was inserted into and removed from the connector housing, and thus the resin cover portion was not damaged. As a result, high anticorrosiveness was maintained even after the terminal-equipped covered electric wire was inserted into and removed from the connector housing. It should be noted that Comparative Example 8 was treated as a comparative example because the adhesive strength at the interface between PBT resin B and thermoplastic elastomer A was less than 1.3 MPa, but PBT resin B has an elastic modulus of 30 MPa or more as is also the case with PBT resin A, and favorable results were also obtained from Comparative Example 8 in the damage test and the subsequent evaluation of the anticorrosiveness.

On the other hand, the PA resins used in Comparative Examples 9 to 11 had an elastic modulus of less than 30 MPa. Accordingly, the results were that the resin cover portions were damaged in the damage test, and the terminal-equipped covered electric wires did not have sufficient anticorrosiveness in the evaluation of the anticorrosiveness. It is construed that the reason for this is that the PA resin having a low elastic modulus was exposed on the surface of the resin cover portion, and therefore, the PA resin was caught on the connector housing while the terminal-equipped covered electric wire was inserted into and removed from the connector housing, and the resin cover portion was thus damaged. Furthermore, it is construed that salt water infiltrated through that damaged portion in the test for the evaluation of the anticorrosiveness, resulting in the occurrence of rust in the electrical connection portion.

LIST OF REFERENCE NUMERALS

1 Terminal-equipped covered electric wire
2 Covered electric wire
3 Electric wire conductor
3*a* End of electric wire conductor
4 Insulator
5 Terminal fitting
51 Connection portion
52 Wire barrel
53 Insulation barrel
6 Electrical connection portion
7 Resin cover portion
7*a* First layer
7*b* Second layer

The invention claimed is:

1. A terminal-equipped covered electric wire comprising:
a terminal fitting; and
a covered electric wire obtained by covering an outer circumference of an electric wire conductor with an insulator,
the terminal fitting and the electric wire conductor being electrically connected in an electrical connection portion,
wherein a resin cover portion that covers an end of the insulator and the electrical connection portion is provided,
the resin cover portion includes a first layer made of a thermoplastic elastomer having adhesiveness to the surface of the terminal fitting, and a second layer made of a polyester resin,
the first layer is arranged at least a part of a portion of the resin cover portion covering the terminal fitting, is in contact with the surface of the terminal fitting, and is not in contact with the insulator,
the second layer is arranged at a partial region of the resin cover portion, is in contact with the surface of the first layer and the surface of the insulator, and covers the entire surface of the first layer,
a tensile shear adhesive strength between the thermoplastic elastomer and the polyester resin is 1.3 MPa or more,
a tensile shear adhesive strength between the thermoplastic elastomer and the surface of the terminal fitting is 1.0 MPa or more, and
a tensile shear adhesive strength between the polyester resin and the insulator is 1.0 MPa or more.

2. The terminal-equipped covered electric wire according to claim 1,
wherein the polyester resin is polybutylene terephthalate resin.

3. The terminal-equipped covered electric wire according to claim 1 wherein the thermoplastic elastomer is a polyester elastomer.

4. The terminal-equipped covered electric wire according to claim 1, wherein the thermoplastic elastomer includes a hard segment and a soft segment, and the soft segment includes polar functional groups.

5. The terminal-equipped covered electric wire according to claim 1, wherein an adhesive strength of the thermoplastic elastomer to the surface of the terminal fitting is 1.0 MPa or more.

6. The terminal-equipped covered electric wire according to claim 1, wherein an adhesive strength of the polyester resin to the insulator is 1.0 MPa or more.

7. The terminal-equipped covered electric wire according to claim 1, wherein the polyester resin has an elastic modulus of 30 MPa or more.

8. The terminal-equipped covered electric wire according to claim 1, wherein the first layer is arranged at a partial region of the resin cover portion, and the second layer covers the entire surface of the first layer.

9. A wire harness comprising the terminal-equipped covered electric wire according to claim 1.

* * * * *